US005169285A

United States Patent [19]

Müller

[11] Patent Number: 5,169,285

[45] Date of Patent: Dec. 8, 1992

[54] APPARATUS FOR SINGULARIZING STACKED SHEETS OF PAPER AND THE LIKE

[75] Inventor: Hans Müller, Zofingen, Switzerland

[73] Assignee: Grapha-Holding AG, Hergiswil, Switzerland

[21] Appl. No.: 595,799

[22] Filed: Oct. 9, 1990

Related U.S. Application Data

[63] Continuation of Ser. No. 317,724, Mar. 2, 1989, abandoned.

[30] Foreign Application Priority Data

Mar. 17, 1988 [CH] Switzerland ..... 017/88

[51] Int. Cl.[5] ..... B65H 39/00

[52] U.S. Cl. ..... 414/797.8; 271/12; 271/91

[58] Field of Search ..... 271/5, 11, 12, 91, 95, 271/260; 414/795.4, 796.1, 796.2, 797.4, 797.8, 797; 198/470.1, 471.1

[56] References Cited

U.S. PATENT DOCUMENTS

| | | | |
|---|---|---|---|
| 2,425,936 | 8/1947 | Hepp | 271/95 |
| 2,721,644 | 10/1955 | Kile | 198/471.1 |
| 3,521,879 | 7/1970 | Niemeyer | 271/95 |
| 3,602,495 | 8/1971 | Hepp | 271/95 |
| 3,720,409 | 3/1973 | Kubo et al. | 271/95 |
| 3,736,213 | 5/1973 | Jorss et al. | 271/95 |
| 4,350,466 | 9/1982 | Bahr et al. | 271/95 |
| 4,482,145 | 11/1984 | Feldkämper et al. | 271/95 |
| 4,801,132 | 1/1989 | Reist | 198/470.1 |

FOREIGN PATENT DOCUMENTS

| | | | |
|---|---|---|---|
| 813482 | 4/1952 | Fed. Rep. of Germany | 271/95 |
| 900815 | 1/1954 | Fed. Rep. of Germany | 271/95 |
| 1202290 | 10/1965 | Fed. Rep. of Germany | 271/95 |
| 2240919 | 3/1973 | Fed. Rep. of Germany | 271/95 |
| 1012970 | 12/1965 | United Kingdom | 271/95 |
| 1295520 | 11/1972 | United Kingdom | 271/95 |

*Primary Examiner*—Sherman Basinger
*Attorney, Agent, or Firm*—Peter K. Kontler

[57] ABSTRACT

Apparatus for singularizing stacked paper sheets has a rotary withdrawing conveyor with an annulus of equidistant satellites having suction cups which attract successive lowermost sheets of a stack in a magazine adjacent a first portion of an endless path for the satellites. The satellites deliver the sheets into a second portion of the endless path where the leaders of the sheets are caused to project radially outwardly and to enter the spaces between the open jaws of grippers which are transported by an endless chain in such a way that a gripper which is about to receive a sheet is moved at the speed of the oncoming sheet-carrying satellite and in the same direction. The satellites have discs cooperating with an endless band serving to gradually release a sheet which is in the process of advancing with a gripper.

16 Claims, 2 Drawing Sheets

APPARATUS FOR SINGULARIZING STACKED SHEETS OF PAPER AND THE LIKE

This application is a continuation of application Ser. No. 317,724, filed Mar. 2, 1989 and now abandoned.

BACKGROUND OF THE INVENTION

The invention relates to apparatus for manipulating sheets, and more particularly to improvements in apparatus for singularizing stacked sheets of paper or the like. Still more particularly, the invention relates to improvements in singularizing apparatus of the type designed to remove successive sheets from a pile of superimposed sheets, for example, in a bookbinding, newspaper assembling or like machine.

German Auslegeschrift No 36 22 960 discloses a singularizing apparatus wherein a set of satellites is mounted for orbital movement along an endless path and each satellite has means for entraining a sheet during travel along a stack of superimposed sheets. If the apparatus of this reference is to singularize relatively large sheets, a number of satellites must be deactivated in order to enable the entraining means of the remaining (active) satellites to properly engage and transport such large sheets without any interference on the part of neighboring satellites. This ensures that successive sheets do not overlap during travel with the respective (active) satellites. A drawback of the just described singularizing apparatus is that its output decreases proportionally with the sizes of sheets which are to be singularized. Furthermore, the mechanism which is used to activate or deactivate selected satellites, depending on the sizes of sheets in a stack which is to be broken up into discrete sheets, is quite complex, expensive and prone to malfunction.

OBJECTS OF THE INVENTION

An object of the invention is to provide a singularizing apparatus whose output does not vary when the apparatus is called upon to shift from processing larger sheets to processing of smaller sheets or vice versa.

Another object of the invention is to provide the apparatus with novel and improved sheet singularizing and transferring devices.

A further object of the invention is to provide the apparatus with novel and improved means for receiving or accepting singularized sheets.

An additional object of the invention is to provide a singularizing apparatus which treats the sheets gently, which can singularize large numbers of sheets per unit of time, and which can be installed in existing production lines as a superior substitute for heretofore used singularizing apparatus.

Still another object of the invention is to provide the apparatus with novel and improved means for transporting sheet-engaging and transferring elements between a source of stacked sheets and a receiving station for discrete sheets.

A further object of the invention is to provide an apparatus which can singularize relative large sheets with the same facility and at the same frequency as relatively small sheets.

SUMMARY OF THE INVENTION

The invention is embodied in an apparatus for singularizing stacked sheets which consist of or contain paper, plastic material or the like. The apparatus comprises a magazine or another suitable source of stacked sheets, and a rotary withdrawing conveyor having a plurality of equidistant transfer elements and means for transporting the transfer elements in a predetermined direction, at a predetermined speed and along an endless path having a first portion adjacent the source and a second portion. The transfer elements have means for entraining successive sheets of the stack in the source during transport along the first portion of the endless path, and the apparatus further comprises means for receiving sheets from successive transfer elements in the second portion of the endless path. The receiving means includes a plurality of grippers and means (e.g., an endless belt or chain conveyor) for moving the grippers along a second path having a portion adjacent the second portion of the endless path. The moving means includes means for advancing the grippers along the portion of the second path at the predetermined speed and in the predetermined direction.

The distribution of transfer elements and of the grippers in the respective (endless and second) paths is preferably such that each gripper enters the portion of the second path while a sheet-carrying transfer element enters the second portion of the endless path. The grippers are or can be equidistant from each other, and each gripper can comprise jaws which are open and confront the oncoming transfer element during movement along the portion of the second path so that the open jaws can accept and engage a sheet which is delivered by the oncoming sheet-carrying transfer element.

The transporting means of the withdrawing conveyor can include means for orbiting the transfer elements about a first axis, and each transfer element can further comprise at least one rotor which is rotatable about a second axis parallel to the first axis. The entraining means can include a flexible element e.g., an endless band or cord) which is trained over the rotors. Each rotor can comprise one or more discs, and the flexible element is trained over a portion of one disc of each transfer element. The apparatus can further comprise guide means (e.g., pairs of idler rollers or driven rollers) for the sheets. Such guide means move with the transfer elements along or close to the endless path and cooperate with the rotors of the transfer elements.

The means for orbiting the transfer elements about the first axis can include two carriers which are spaced apart from each other in the direction of the first axis. The transfer elements are disposed between the two carriers and at least one of the carriers is preferably provided with one or more windows which afford access to the space between the two carriers. Each transfer element can be journalled in the carriers for rotation about the respective second axis.

The entraining means of each transfer element can comprise one or more suction-operated devices which attract sheets during transport of transfer elements past the source of stacked sheets. At least one of the carriers can support pulleys for the aforementioned flexible element of the entraining means, and such pulleys can alternate with the transfer elements.

The novel features which are considered as characteristic of the invention are set forth in particular in the appended claims. The improved singularizing apparatus itself, however, both as to its construction and its mode of operation, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
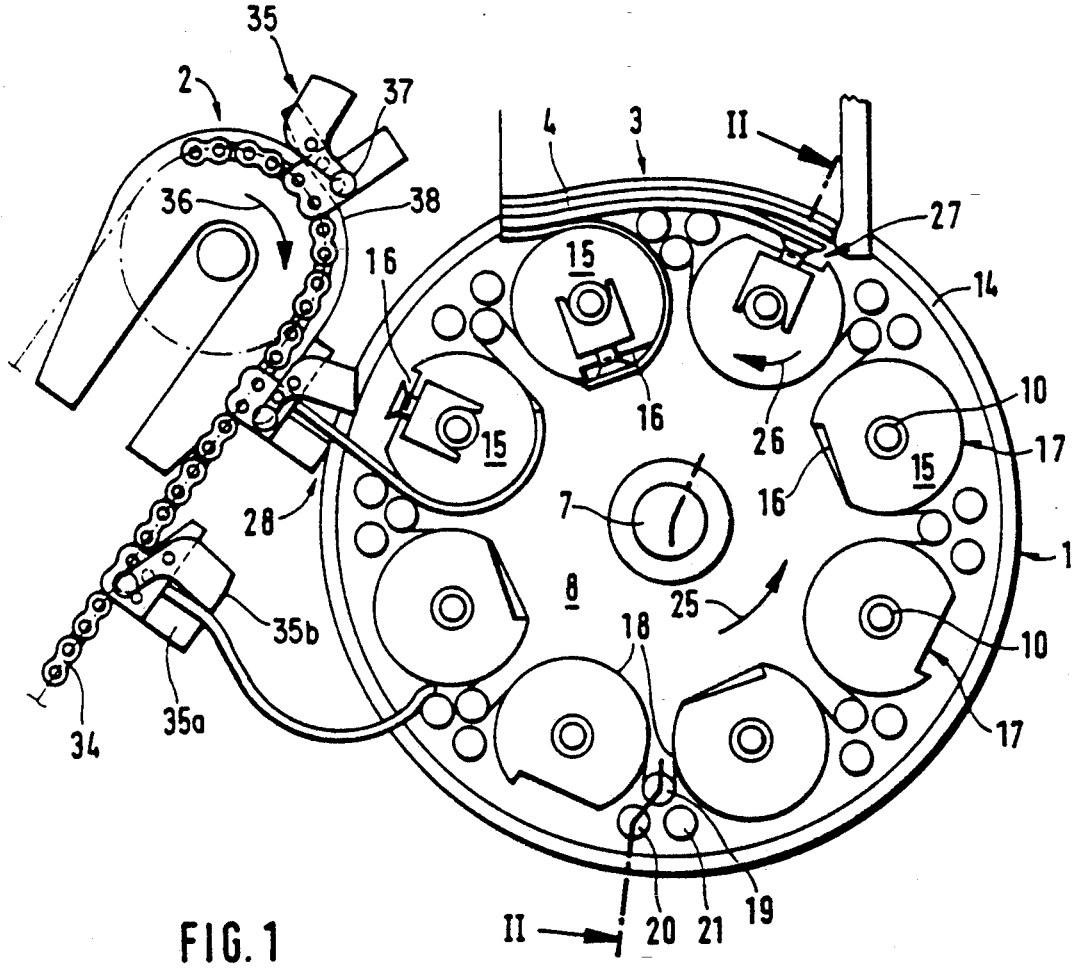
FIG. 1 is a schematic elevational view of a singularizing apparatus which embodies one form of the invention and wherein the sheet withdrawing conveyor has eight equidistant transfer elements.

The singularizing apparatus which is shown in FIG. 1 comprises a magazine 3 which constitutes a source of stacked sheets 4, a withdrawing conveyor 1 which has a set of eight equidistant transfer elements 17, and a second conveyor 2 constituting a means for receiving discrete sheets from successive transfer elements 17 of the withdrawing conveyor 1. The sheets 4 can be provided with printed matter, and each such sheet can comprise a plurality of panels which are folded over each other. For example, each sheet 4 can constitute a signature or an inset for a newspaper (e.g., for a weekend edition of a newspaper).

Figure 2:
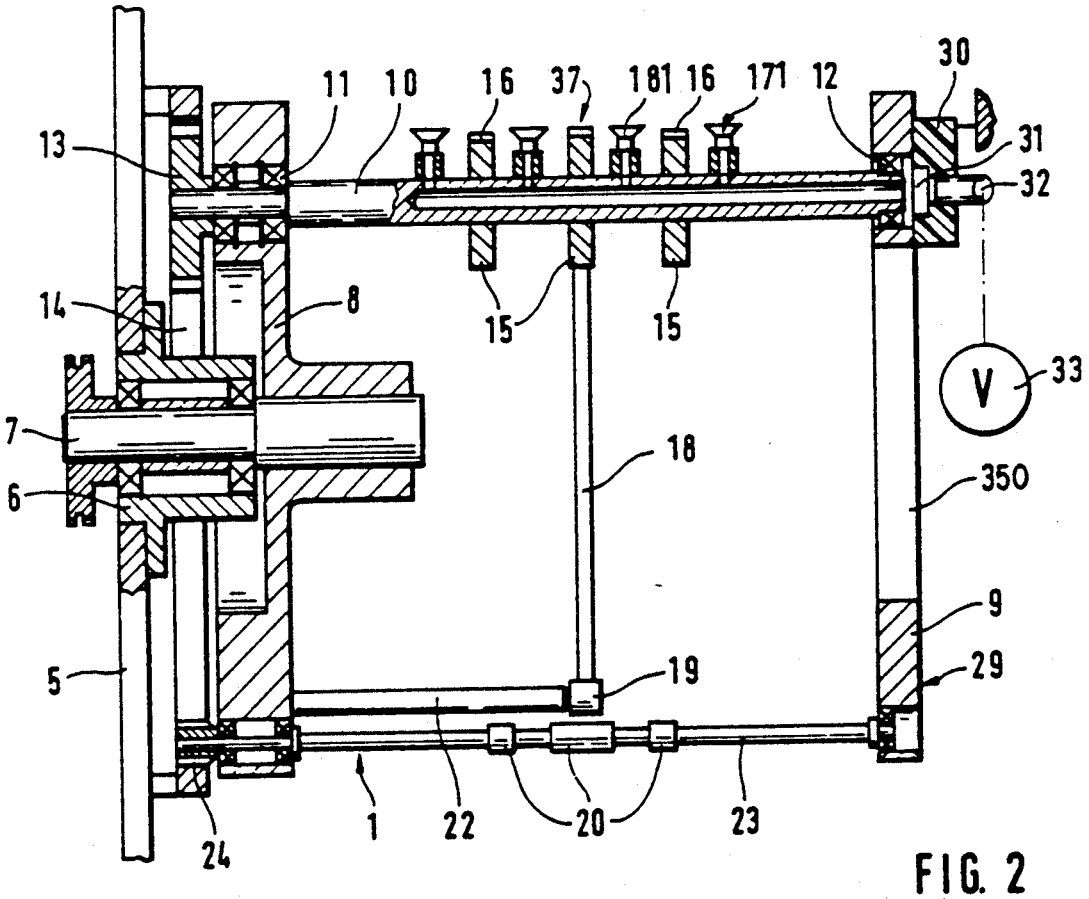
FIG. 2 is a sectional view of the sheet withdrawing conveyor, substantially as seen in the direction of arrows from the line II—II of FIG. 1.

As can be seen in FIG. 2, the sheet withdrawing conveyor 1 is rotatably mounted on a wall or cheek 5 which can be installed in a production line serving to turn out books, newspapers or other products which are assembled of or contain sheets. The means for orbiting the transfer elements 17 (hereinafter called satellites) along an endless circular path comprises a shaft 7 which is journalled in a bearing sleeve 6 of the wall 5 and is driven at a predetermined (constant or variable) speed by a suitable motor (not shown) to drive a disc-shaped first carrier 8 for the hollow shafts 10 of the satellites 17. A ring-shaped second carrier 9 is spaced apart from the carrier 8 in the direction of the axis of the shaft 7 and serves to rotatably support the respective end portions of the shafts 10. The shafts 10 are elongated tubes or pipes each of which has a closed end in the region of the carrier 8 and an open end in the region of the carrier 9.

The shafts 10 are mounted in antifriction bearings 11 which are installed in the preferably circular disc-shaped carrier 8, and in antifriction bearings 12 which are installed in the ring-shaped carrier 9. The closed end portions of the shafts 10 extend beyond the carrier 8 (in a direction away from the carrier 9) and are rigidly connected with pinions 13 mating with an internal gear 14 which is affixed to the respective side of the wall 5. Thus, when the shaft 7 rotates the carrier 8, the shafts 10 rotate the carrier 9 with the carrier 8 about a common axis (of the shaft 7), and the shafts 10 simultaneously rotate about their own axes because the pinions 13 roll along the internal gear 14 on the wall 5. The carriers 8, 9 rotate counterclockwise (note the arrow 25 in FIG. 1), and the shafts 10 rotate clockwise with respect to the carriers 8 and 9 (note the arrow 26 in FIG. 1).

Each satellite 17 comprises a rotor having three coaxial discs 15 which are spaced apart from each other in the direction of the axis of the respective hollow shaft 10. The discs 15 of each rotor are non-rotatably mounted on the respective shaft 10 and alternate with suction-operated devices 171 including suction cups 181 which serve to attract the lowermost sheet 4 of the stack in the magazine 3 during travel along that portion of the endless path for the satellites 17 which is adjacent the underside of the magazine. The suction-operated devices 171 constitute component parts of means for entraining successive sheets 4 from the magazine 3 and for transporting such sheets in the direction of arrow 25 toward and into a second portion of the endless path where the sheets are accepted by successive grippers 35 of the receiving conveyor 2. The first portion of the endless path (where the entraining means of successive satellites 17 extract successive lowermost sheets 4 of the stack in the magazine 3) is shown at 27, and the second portion of this path (namely the portion where the singularized sheets 4 are accepted by successive grippers 35 of the receiving conveyor 2) is denoted by the character 28. The entraining means for the sheets 4 further comprises an endless flexible band 18 which is trained over portions of central discs 15 of all eight satellites 17 and is further trained over pulleys 19 alternating with the sets of discs 15 (in the circumferential direction of the carriers 8, 9) and being mounted on at least one of the carriers. The band 18 can be trained over the median disc 15 of each satellite 17 along an arc of approximately 180°, and this band cooperates with pairs of guide elements 20, 21 which are outwardly adjacent the pulleys 19 and cooperate with the adjacent discs 15 to properly guide the sheets 4 from the portion 27 toward and into the portion 28 of the endless path for the satellites 17.

As can be seen in FIG. 2, each pulley 19 is mounted on an elongated rod 22 which is affixed to the carrier 8 to orbit about the axis of the shaft 7. Each guide element 20 can comprise three spaced-apart coaxial rollers mounted on a common shaft 23 which is rotatably journalled in the carriers 8, 9 and carries a pinion 24 in mesh with the internal gear 14. The rods 22 and the shafts 23 are parallel to the shafts 7 and 10. Each guide element 21 is or can be identical with a guide element 20 and is mounted in the same way as the elements 20 for rotation about an axis which is parallel to the axes of the shafts 7, 10, 23 and rods 22. When the carrier 8 is driven by the shaft 7, the gears 24 of the guide elements 21, 22 roll along the internal gear 14 and are caused to rotate in the same direction (note the arrow 26 in FIG. 1) as the shafts 10.

Each disc 15 of each rotor has a flat 16 which is in line with the adjacent suction cups 18.

The operation is as follows:

When the shaft 7 is driven to rotate the carrier 8 in the direction of arrow 25, the carrier 8 rotates the shafts 10 which rotate the carrier 9 whereby the pinions 13 roll along the internal gear 14 and cause the satellites 17 to rotate about the axes of the respective shafts 10 (arrow 26). Successive satellites 17 advance toward, past and beyond the portion 27 of their endless path. The suction cups 181 of the suction-operated devices 171 are connected to a suction generating device 33 during travel past the magazine 3 as well as during travel from the portion 27 toward the portion 28 of the endless path for the satellites 17. Therefore, the suction cups 181 of successive satellites 17 engage the lowermost sheet 4 of the stack in the magazine 3 along the fold line of such sheet (it being assumed here that each sheet has at least two panels which are folded over each other). As a satellite 17 advances beyond the path portion 27, its discs 15 roll along the sheet 4 which is attracted by the respective suction cups 181. The suction cups 181 of such satellite 17 remain connected to the suction generating device 33 until the sheet 4 which has been removed from the magazine 3 is clamped between the respective discs 15 and the endless band 18. Thus, when the fold line (at the leading end) of the sheet 4 which advances toward the path portion 28 is clamped between the respective discs 15 and the band 18, such sheet is held by the respective satellite 17 only by mechanical means because the band 18 cooperates with the discs 15 to prevent the sheet from leaving the satellite which is in the process of advancing toward the oncoming gripper 35 of the receiving conveyor 2. If necessary, the guide elements 20 and 21 assist the band 18 and the discs 15 in properly holding the sheet 4 on its way toward the open jaws 35*a*, 35*b* of the oncoming gripper 35.

The means for connecting the suction cups 181 to the suction generating device 33 includes the respective hollow shafts 10 and a stationary valving element 30 which is biased toward the outer side 29 of the rotating carrier 9 and has an arcuate groove 31 connected with the intake of the suction generating device 33 by a conduit 32. The length of the groove 31 in the valving element 30 is selected in such a way that the open right-hand end of a shaft 10 begins to communicate with the groove 31 in good time before, or not later than when, the respective suction cups 181 reach the path portion 27. The valving element 30 can constitute a circumferentially complete ring or a relatively short section of a ring which is sealingly urged against the outer side 29 of the carrier 9 by one or more springs or the like.

When a sheet 4 is about to reach the path portion 28, its leader (including the fold line) extends substantially tangentially of the discs 15 forming part of the respective rotor and projects at least slightly outwardly beyond the corresponding satellite so that it can enter the space between the jaws 35*a*, 35*b* of the oncoming gripper 35. The grippers 35 are driven at the speed of the satellites 17, at least in that portion of their path which is adjacent the path portion 28, and such grippers then advance in the same direction (arrow 36) as the satellite 17 which is in the process of delivering a sheet 4 to the receiving conveyor 2. The means for moving the grippers 35 along a second endless path comprises an endless chain 34. That portion of the second path where a gripper 35 receives a sheet 4 from the oncoming satellite 17 is adjacent the path portion 28. The grippers 35 on the chain 34 (which can be replaced by one or more endless belts) are equidistant from each other. The space between the open jaws 35*a*, 35*b* of the gripper 35 which approaches the path portion 28 confronts the oncoming satellite 17 and is ready to receive the outwardly projecting leader of the sheet 4 which is about to be transferred onto the receiving conveyor 2. The means for closing the jaws 35*a*, 35*b* of the gripper 35 which has received the leader of a sheet 4 includes a roller follower 37 on one of the jaws 35*a*, 35*b* and a stationary cam 38 which is tracked by the roller follower 37 of the jaw advancing beyond the path portion 28. The gripper 35 which holds the leader of a sheet 4 then extracts such sheet from between the band 18 and the discs 15 of the respective satellite 17 so that the sheet advances along the path which is defined by the chain 34. The mutual spacing of grippers 35 and the speed of the chain 34 are preferably selected in such a way that an intermediate portion of each sheet 4 is looped (at least slightly) during the initial stage of travel with the chain 2. This renders it possible to obviate the need for actual extraction of the sheet 4 from the space between the band 18 and the respective set of discs 15, i.e., the discs 15 rotate about their own axes and roll along the band 18 to thus gradually expose a progressively increasing portion of the sheet 4 in a direction from the fold line at the leading end toward the trailing end of the sheet.

The grippers 35 are caused to open their respective jaws 35*a*, 35*b* when the sheets 4 reach their destination where they are taken over by other transporting means (not shown) or are permitted to descend by gravity. The distances between neighboring grippers 35 and the speed of the chain 34 determine the frequency at which the singularized sheets 4 are delivered by the conveyor 2 to the next processing station.

The carrier 9 is provided with at least one window, e.g., with a centrally located window 350, which affords access to the space between the carriers 8 and 9. The window 350 is preferably large so that it permits convenient extraction of damaged sheets (if any) which gather in the space located radially inwardly of the shafts 10.

An important advantage of the improved apparatus is its ability to singularize large and small sheets with the same facility and reliability. In addition, the output of the apparatus need not be reduced if the magazine 3 contains relatively large sheets. Moreover, defective sheets 4 can be removed from the conveyor 1 while the apparatus is in actual use, and the transfer of sheets onto the conveyor 2 can take place without undue, or without any, stretching of the sheets.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should are intended to be comprehended within the meaning and range of equivalence of the appended claims.

I claim:

1. Apparatus for singularizing stacked sheets, comprising a source of stacked sheets; a rotary withdrawing conveyor having a plurality of equidistant transfer elements and means for transporting said transfer elements in a predetermined direction, at a predetermined speed and along an endless path having a first portion adjacent said source and a second portion, said transfer elements having means for entraining successive sheets of the stack from said source during transport along the first portion of said path and said transporting means including means for orbiting said transfer elements about a first axis, each transfer element further comprising at least one rotor rotatable about a second axis which is parallel to said first axis and said entraining means including a flexible element trained over said rotors; and means for receiving sheets for successive transfer elements in the second portion of said path, including a plurality of grippers and means for moving said grippers along a second path having a portion adjacent the second portion of said endless path, said moving means including means for advancing the grippers along said portion of said second path at said predetermined speed and substantially in said predetermined direction.

2. The apparatus of claim 1, wherein the positions of transfer elements and of grippers relative to the respective paths are such that a gripper enters said portion of said second path while a sheet-carrying transfer element enters the second portion of said endless path.

3. The apparatus of claim 1, wherein said grippers are equidistant from each other.

4. The apparatus of claim 3, wherein said grippers include jaws which are open and confront the oncoming transfer elements during movement along said portion of said second path.

5. The apparatus of claim 1, wherein each of said rotors comprises at least one disc and said flexible element is trained over portions of said discs.

6. The apparatus of claim 5, wherein said flexible element includes an endless band.

7. The apparatus of claim 1, wherein said moving means comprises an endless conveyor.

8. Apparatus for singularizing stacked sheets, comprising a source of stacked sheets; a rotary withdrawing conveyor having a plurality of equidistant transfer elements and means for transporting said transfer elements in a predetermined direction, at a predetermined speed and along an endless path having a first portion adjacent said source and a second portion, said transfer elements having means for entraining successive sheets of the stack from said source during transport along the first portion of said path and said transporting means including means for orbiting said transfer elements about a predetermined axis, said means for orbiting including two carriers spaced apart in the direction of said axis and said transfer elements being disposed between said carriers, one of said carriers having at least one window affording access to the space between said carriers; and means for receiving sheets from successive transfer elements in the second portion of said path, including a plurality of grippers and means for moving said grippers along a second path having a portion adjacent the second portion of said endless path, said moving means including means for advancing the grippers along said portion of said second path at said predetermined speed and substantially in said predetermined direction.

9. The apparatus of claim 8, wherein each of said transfer elements is journalled in said carriers for rotation about a second axis parallel to said predetermined axis.

10. The apparatus of claim 8, wherein said entraining means including suction-operated devices for attracting sheets during transport of said elements along the first portion of said endless path.

11. The apparatus of claim 8, wherein each of said entraining means including a rotor and further comprising an endless flexible element trained over a portion of each rotor, said transporting means including at least one rotary carrier for said transfer elements and further comprising pulleys for said flexible element, said pulleys alternating with said rotors and being provided on said carrier.

12. Apparatus for singularizing stacked sheets, comprising a source of stacked sheets; a rotary withdrawing conveyor having a plurality of equidistant transfer elements and means for transporting said transfer elements in a predetermined direction, at a predetermined speed and along an endless path having a first portion adjacent said source and a second portion, said transfer elements having means for entraining successive sheets of the stack from said source during transport along said first portion of said path, said entraining means including suction-operated devices for attracting sheets during transport of said elements along the first portion of said path; and means for receiving sheets from successive transfer elements in the second portion of said path, including a plurality of grippers and means for moving said grippers along a second path having a portion adjacent the second portion of said endless path, said moving means including means for advancing the grippers along said portion of said second path at said predetermined speed and substantially in said predetermined direction.

13. The apparatus of claim 13, wherein said transporting means includes means for orbiting said transfer elements about a first axis and each transfer element further comprises at least one rotor rotatable about a second axis which is parallel to said first axis, said entraining means including a flexible element trained over said rotors.

14. The apparatus of claim 13, further comprising guide means for sheets which move with said transfer elements, said guide means cooperating with said rotors.

15. The apparatus of claim 12, wherein said transporting means includes means for orbiting said transfer elements about a predetermined axis, said means for orbiting including two carriers spaced apart in the direction of said axis and said transfer elements being disposed between said carriers, one of said carriers having at least one window affording access to the space between said carriers.

16. Apparatus for singularizing stacked sheets, comprising a source of stacked sheets; a rotary withdrawing conveyor having a plurality of equidistant transfer elements and means for transporting said transfer elements in a predetermined direction, at a predetermined speed and along an endless path having a first portion adjacent said source and a second portion, said transfer elements having means for entraining successive sheets of the stack from said source during transport along said first portion of said path and each of said entraining means including a rotor, said conveyor further comprising an endless flexible element trained over a portion of each rotor, said transporting means including at least one rotary carrier for said transfer elements and said conveyor further comprising pulleys for said flexible element, said pulleys alternating with said rotors and being provided on said carrier; and means for receiving sheets from successive transfer elements in the second portion of said path, including a plurality of grippers and means for moving said grippers along a second path having a portion adjacent the second portion of said endless path, said moving means including means for advancing the grippers along said portion of said second path at said predetermined speed and substantially in said predetermined direction.

* * * * *